United States Patent [19]

Flaska et al.

[11] Patent Number: 4,488,668

[45] Date of Patent: Dec. 18, 1984

[54] TWO-PIECE SIFTER CLOSURE FOR FILLABLE CONTAINER

[75] Inventors: Joseph M. Flaska, Somerville; Robert F. Wittemann, Belle Mead, both of N.J.

[73] Assignee: Johnson & Johnson Baby Products, New Brunswick, N.J.

[21] Appl. No.: 417,950

[22] Filed: Sep. 14, 1982

[51] Int. Cl.[3] ..... B65D 47/00

[52] U.S. Cl. ..... 222/548; 222/485

[58] Field of Search ..... 222/545, 548, 514, 565, 222/484, 480, 485; 215/329, 331

[56] References Cited

U.S. PATENT DOCUMENTS

| | | | |
|---|---|---|---|
| 2,327,391 | 8/1943 | Baker | 222/548 |
| 3,093,272 | 6/1963 | Esthus | 222/548 |
| 3,260,423 | 7/1966 | Fillmore et al. | 222/545 |
| 3,276,643 | 10/1966 | Klygis | 222/545 |

*Primary Examiner*—H. Grant Skaggs
*Assistant Examiner*—Kenneth Noland
*Attorney, Agent, or Firm*—Jason Lipow

[57] ABSTRACT

A container having a fillable opening is provided with a sifter closure comprising an outer cap and a sifter disk. The sifter disk is fitted into a cap and is self-registering therewith. The cap and sifter disk may then be placed onto the container and the sifter disk immovably affixed to the container to assemble the container enclosure.

11 Claims, 11 Drawing Figures

TWO-PIECE SIFTER CLOSURE FOR FILLABLE CONTAINER

BACKGROUND OF THE INVENTION

This invention relates to an improvement in a container for dispensing particulate matter such as powders or finely ground fibers as, for example, talc, body powders, cosmetic face powders, soap powders or the like. In particular, this invention is directed toward the design and method of assembling such a container having a sifter-like dispensing closure which design and method is inherently simpler than prior efforts and, particularly, in the case of powders used for babies, is substantially safer.

Several designs already exist for containers to be filled with particulate matter and used for dispensing such matter through sifter means. In general these prior designs comprise a wide mouthed opening to facilitate filling and closure means which comprise two or more parts, each having a pattern of perforations therethrough, through which the particulate matter is to be dispensed in use. The pattern of perforations in at least two of the parts are so designed as to allow the user to rotate them, with respect to each other, into and out of alignment so as to open and close the container for dispensing and storage, respectively.

One such prior design is disclosed in U.S. Pat. No. 3,194,455 issued on July 13, 1965 to C. Castelli. A similar suggestion is found in U.S. Pat. No. 3,276,643 issued on Oct. 4, 1966 to M. J. Klygis. In accordance with these disclosures, a dispensing closure for a fillable container is provided and consists of two pieces; a sifter plate and a cap. The sifter plate nests within the cap and this assembly is placed over a neck surounding the fillable opening of the container. The rotation of the cap is restricted by projections provided on the outer wall of the neck which cooperate with the inner wall of the cap. By first properly registering the sifter into the cap and then properly registering the subassembly onto the neck to overlie the fillable opening of the container, the limits of rotation of both the sifter and the cap with respect to each other correspond to the open and closed position for dispensing and storage.

Unfortunately, this design presents several drawbacks. Firstly, the assembly of this closure involves two precise registration steps; the sifter into the container and the cap onto the neck of the container. Such registration steps are time consuming and expensive in terms of mass produced products such as are being considered herein. Further, this design requires precision molding of the various projections in the cap, sifter and neck all of which are difficult to accomplish, expensive and result in a high rejection rate of improperly molded parts. Perhaps most importantly, this design requires that to assemble the container, the sifter be unaffixed to either the cap or the neck. Accordingly, in the event that the cap is pried off the top of the neck, as by a child, the sifter is loose and may be dangerous to a young child, i.e., swallowed. Additionally, the total contents can be inadvertently spilled, inhaled or injested.

Several alternative suggestions have also been disclosed. In U.S. Pat. No. 2,495,806 issued to H. Block on Jan. 31, 1950, a two piece assembly has been suggested wherein a disk is riveted to the inside of a cap, both of which are provided with apertures. The disk is provided with a knob extending out of the top of the cap which may be gripped and turned thereby rotating the disk with respect to the removable, stationary cap. The travel of the disk relative to the cap into an open and closed position is controlled by a pair of projections in the disk cooperating with a pair of slots in the cap and limiting the rotation of the disk to the angle transversed by the projection between the ends of the slot. While this system does indeed simplify the molding procedure, it leaves the container entirely open should the cap be removed and hence is unsafe. Further, the riveting operation joining the disk to the cap is costly and undesirable.

In U.S. Pat. No. 1,391,772 issued on Sept. 27, 1921 to U. G. Dunham and U.S. Pat. No. 1,301,847 issued on Apr. 29, 1919 to E. Hoffman the slot/projection concept described above is utilized while still maintaining the container closed. These patents have described a three piece closure system which requires two separate registration steps and hence, for these reasons, is undesirable.

Still other suggested devices are described in U.S. Pat. Nos. 2,003,506; 3,260,426; and 3,325,066. For reasons similar to those outlined above, the suggestion found in these patents are either difficult to mold, difficult to assemble or unsafe when assembled.

Accordingly, there is a need for a simple, easy to assemble, safe sifter closure system for a fillable container.

SUMMARY OF THE INVENTION

In accordance with this invention, a container having a fillable opening is provided with a sifter closure which is simple to construct, simple to assemble and safe in use, particularly with respect to the safety of small children.

The closure of this invention comprises two pieces; an outer cap and a sifter disk. As assembled about a fillable opening, the outer cap overlies said opening and is rotatably engaged upon said container. The cap is provided with a closed top having a pattern of apertures therethrough for dispensing the contents of the container. The inner surface of the top is provided with one or more projections extending toward the fillable opening of the container.

A disk is provided, immovably affixed to the container and overlying the fillable opening. The disk has a pattern of apertures therethrough with which the apertures in the cap may be rotated into alignment for dispensing the contents of the container. The disk is further provided with one or more slots for engaging each of the cap projections, said cap projections traveling within said slots as the cap rotates. Means are provided for limiting the travel of the cap projections within the slot. The projections and the slots are positioned so that at a first extreme limit of travel of the projection within the slot, the apertures in the cap align with the apertures in the disk to allow dispensing of the contents. At the second extreme limit of travel of the projections within the slot, the apertures in the cap are misaligned with the apertures in the disk and prevent dispensing of the contents.

In an embodiment of the invention, the means for limiting the rotation of the cap comprises a plurality of bosses angularly placed about the external surface of a neck forming the fillable opening of the container. These bosses cooperate with a second plurality of bosses angularly placed about the inside wall of said cap whereby, when said cap is fitted onto the neck and rotated, rotation will be limited in each direction to the point at which a neck boss bears against a cap boss.

In another embodiment of this invention, the bosses are dispensed with and instead, the rotation of the cap is limited by the travel of the cap projections from one extreme end of the disk slot to the other.

In still another embodiment of the invention, the cap projections comprise a post extending from the inside of the cap top and terminating in an enlarged portion having a width greater than the width of at least the narrowest part of the slot. In this embodiment, the enlargement serves to hold the disk to the cap in subassembly prior to the cap being placed onto the container. The slot may also be shaped to have a varying width, decreasing in width from one end to the other whereby the projection may be fitted over the wide end of the slot and the disk then rotated with respect to the cap so that the projection enlargement is then in the narrow end, thereby holding the disk to the cap until final assembly by virtue of the projection enlargement engaged by the narrow end of the slot.

In still another embodiment, the slot is provided with a constriction or neck near one end of the slot. The disk is placed into the cap so that the cap projection is at this constructed end of the slot and is impeded from rotating toward the other end and by virtue of the constriction. When rotation is desired, as, for example, after assembly of the container and when attempting to dispense the contents, the cap may be rotated and the projection may be forced passed the constriction. By choosing the materials of construction for the disk to be deformable or sufficiently flexible, the disk may be held in its proper position during assembly but rotated after assembly by asserting sufficient deforming or flexing force. Suitable materials of construction may be, for example, paperboard, polymeric materials metals or the like.

In accordance with the method of this invention the disk is placed into the cap with the cap projections engaged by the disk slot and rotated into the closed position. The cap is then placed over the fillable opening of the container and the disk is then immovably sealed to the container. Because the disk is in registry with the cap, there is no further registration required when placing the cap and disk subassembly onto the container. Because the disk is sealed to the container, even if the cap were removed, the disk would not come loose and present a danger to a child. Further, the bulk of the contents of the container would be impeded from spilling except to a minor degree through the apertures of the disk.

BRIEF DESCRIPTION OF THE DRAWINGS

The invention will be best understood by a consideration of the following description taken together with the appended drawings in which.

DETAILED DESCRIPTION OF THE INVENTION

Figure 1:
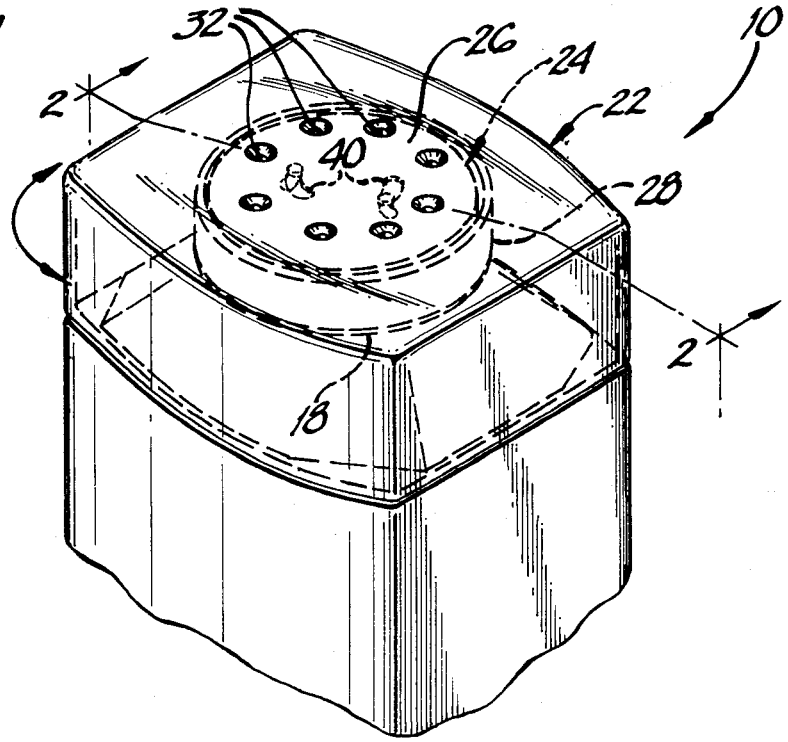
FIG. 1 is a perspective view of the top portion of a container incorporating the teachings of this invention.
Figure 2:
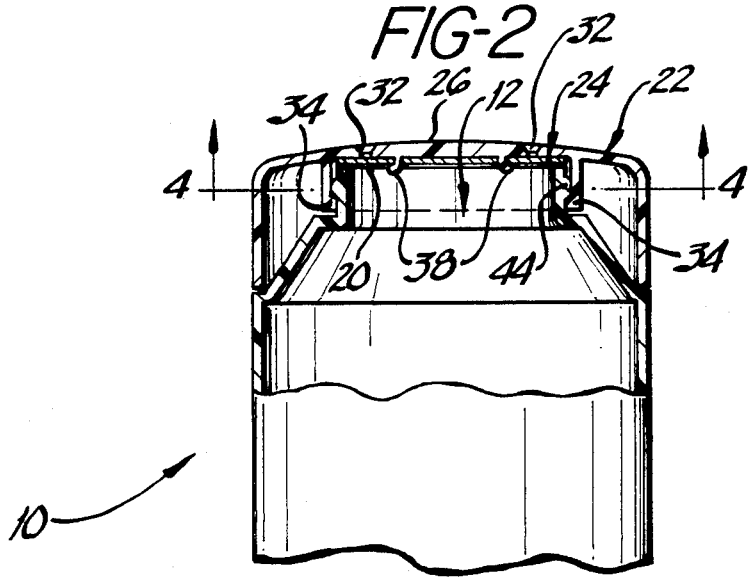
FIG. 2 is an elevational, cross-sectional view of the container of FIG. 1, taken through line 2—2.
Figure 3:
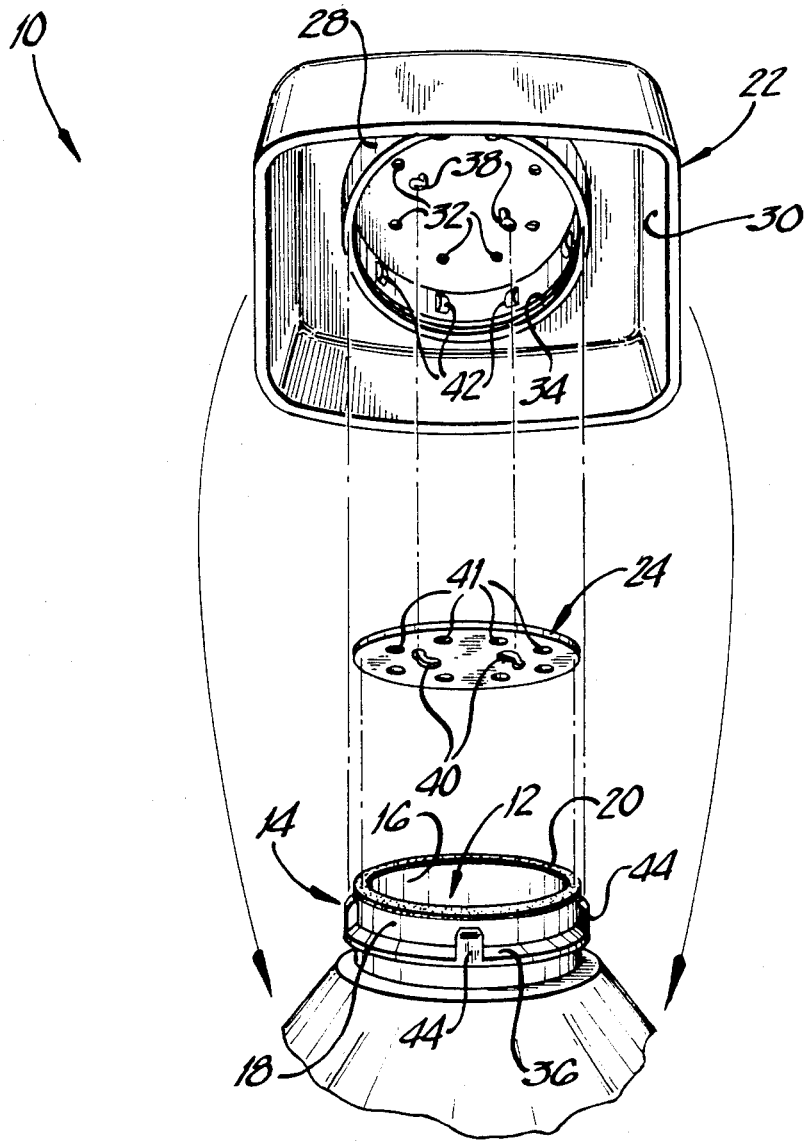
FIG. 3 is an exploded, perspective view of the container of FIG. 1, with each part viewed at a different angle of perspective, to better illustrate each element thereof.

Referring now to FIGS. 1–3, illustrated therein in perspective, cross-sectional and exploded perspective views, respectively, is a container 10 embodying the teachings of this invention. The container 10 has a wide fillable opening 12 suitable for rapid filling during the manufacturing process with such particulate matter as powders and the like. As illustrated in this embodiment, the opening 12 is defined by an upstanding peripheral neck 14 having an internal wall 16, an external wall 18 and a top wall 20.

A two-piece closure for opening 12 is provided comprising a cap 22 and a disk 24.

The cap 22 comprises a top 26 and a skirt 28 for rotatably engaging the neck 14 of container 10 and overlying the opening 12. As is illustrated in the drawings, the cap may have an extended top which is larger than the opening 12 and may be provided with outer walls, such as walls 30. It will be understood that to operate as a closure it is necessary that the top 26 be at least coextensive with the opening and that the cap have a skirt 28 for engaging the neck 14. However, these necessary features do not limit the general outward appearance of the cap and by extending the surface of the top 26 and providing outer wall 30, the cap may take any shape, such as the generally rectangular configuration shown in the drawing or, for example, an oval configuration. Such shape may be chosen on the basis of aesthetics or to serve some functional purpose other than those being considered herein.

The top 26 of the cap 22 is provided with a pattern of apertures 32, arranged in a circle about the center of the top for ultimately allowing the contents of the container to be dispensed therethrough. As is illustrated in this embodiment, there are eight such apertures separated from each other by an angle of 45° on the circle representing the locus of the aperture centers. Preferably, these apertures have the shape of truncated cones, with the narrow portion terminating on the inside surface of the top 28. This configuration facilitates the dispensing of fine particulate materials.

The inside surface at the bottom of the skirt 28 of the cap is provided with a narrow beveled flange 34 which is adapted to fit over a similar flange 36 on the outer surface of the neck 18 for rotatably securing the cap to the neck. Also provided on the inside surface of skirt 28 are a series of angularly spaced bosses 42 which, when the cap is rotatably secured to the neck, cooperate with bosses 44 on the outer surface of the neck to limit the rotation of the cap about the neck.

Depending from the inside surface of the top 26 of cap 22 are projections 38 for cooperating with corresponding arcuate slots 40 in the disk 24. Disk 24 is immovably affixed to the top wall 20 of the neck 14 and contains a pattern of apertures 41 therethrough, with which the apertures 32 in cap 22 may be rotated into alignment for dispensing the contents of the container.

Figure 4:
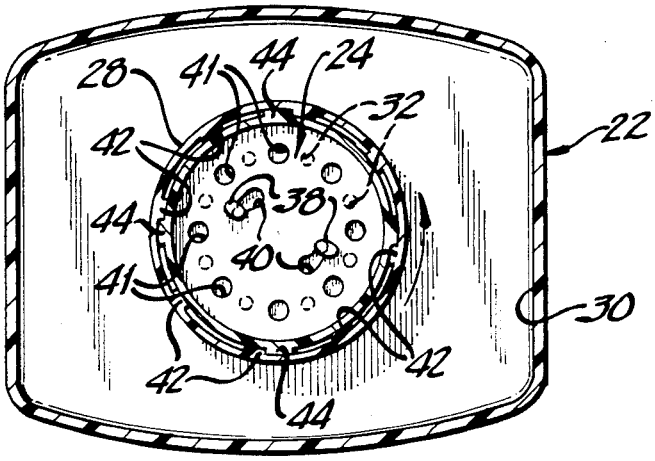
FIG. 4 is a cross-sectional view of the assembled container of FIG. 1 in the non-dispensing position, taken along line 4—4 of FIG. 2 and viewed toward the top of the container.
Figure 5:
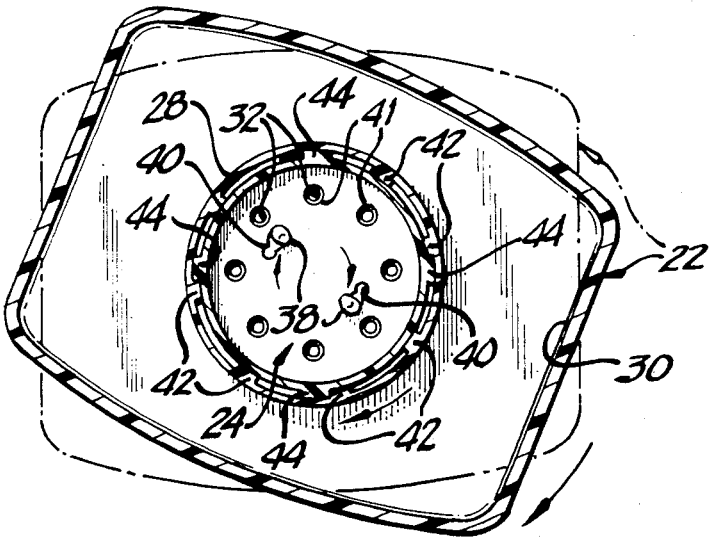
FIG. 5 is a cross-sectional view of the assembled container and similar to that of FIG. 4 except that the container cap has been rotated into the dispensing position.

Referring now to FIG. 4, a cross-sectional view of the assembled closure and container of FIGS. 1 and 2 are illustrated, viewed upward into the cap. As in FIGS. 1 and 2, the cap is in the closed, i.e., non-dispensing, position with the apertures in the cap being occluded by the disk and the apertures in the disk being occluded by the top of the cap. In this position it can be seen that first alternate cap bosses 42 bear against corresponding first alternate neck bosses 44 precluding further rotation of the cap in the counterclockwise direction. In FIG. 5, a similar view is provided, however, the cap is now rotated in the clockwise direction so that second alternate cap bosses 42 bear against second alternate neck bosses 44 at a position where the apertures in the stationary disk are in alignment with the apertures in the cap for dispensing the contents of the container.

In the specific embodiment shown in the drawing having the aperture spaced at 45° angles, it can be seen that the full travel of the cap from a fully open to a fully closed position (with the disk apertures midway between adjacent cap apertures in plan view) is 22.5°. Accordingly, the travel of the cap projections 38 within the slots 40 likewise extends through an angle of 22.5°.

As will be understood from the drawings, the cooperating cap bosses and neck bosses limit travel of the cap to 22.5° as does the length of the slot which, for the embodiment illustrated, also corresponds to 22.5°. For practical purposes, it is not possible to ensure both these rotational limiting means to limit rotation of the cap to precisely the same angle and accordingly when bosses are used in conjunction with the slots it is generally the bosses which limit rotation and the slots are generally longer. The use of the bosses as the rotation limiting means are preferred when the cap and the neck are constructed of a relatively strong material, i.e., polyethylene or polypropylene, and the disk is relatively weak, i.e., paperboard.

It will be understood however that the disk slots 40 may be used as the rotational limiting means in which case the providing of bosses may be entirely dispensed with.

The inherent safety of the closure system of this invention should now be apparent. The cap is snap-fitted over the neck with the disk affixed to the top wall of the neck. As so assembled, it can be seen that the cap is vulnerable to being pried off, particularly by a small child. This situation is aggravated by a cap having the overall rectangular shape such as is illustrated in the drawings. Referring to FIG. 5, when such a cap is rotated into the open position, the cap wall 30 provides a portion for gripping and prying the cap from the neck. This vulnerability notwithstanding, even if the cap were removed, the disk will not be loose but instead will be firmly affixed to the neck thereby avoiding the dangers of prior designs. Further the bulk of the contents will remain in the container as the opening 12 remains sealed by the disk with the exception of the relatively small apertures 41.

Figure 6A:
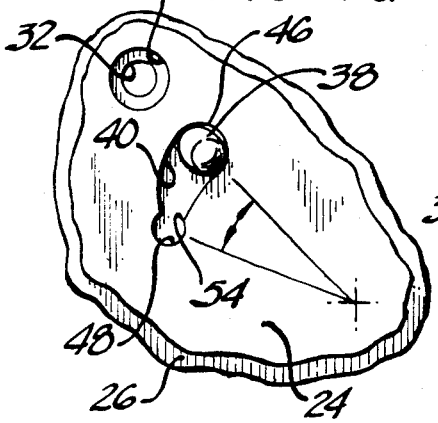
FIG. 6*a* is an enlarged view of a portion of the container viewed in FIG. 4 and illustrating the engagement of a cap projection in a disk slot when the container is in the non-dispensing position.
Figure 6B:
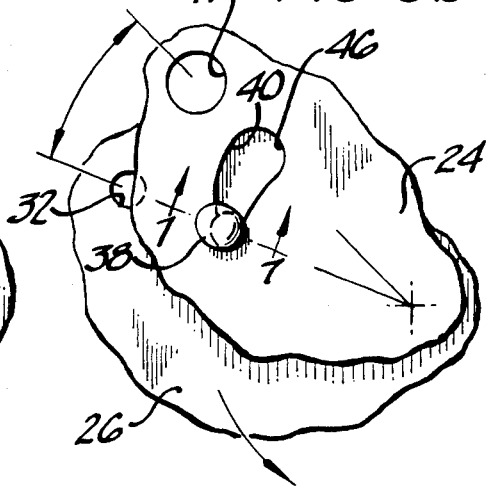
FIG. 6 is an enlarged view of a portion of the container viewed in FIG. 5 illustrating the engagement of the cap projection in a disk slot when the container is in the dispensing position.

FIG. 6 and 6*a* illustrate, in the preferred embodiment of this invention, an enlarged view of the disk and cap top 26 with the projection 38 engaging the disk slot 40. Preferably, the slot has a wide end 46 and a narrow end 48 and is so positioned on the disk such that when the wide end is engaged by the projection of the cap, the disk apertures align with the cap apertures, i.e., the disk and cap are in the open or dispensing position (see FIG. 6). Similarly, the parts are so positioned such that when the cap projection is in the narrow end 48, the disk apertures are out of alignment with the cap apertures, i.e., the disk and cap are in the closed or non-dispensing position.

The closure may be assembled and fitted to the filled container with minimum registration steps. The disk is first fitted into the cap with the projections of the cap engaging the disk slot as shown in FIG. 6. The disk is then rotated into the closed position (clockwise in the drawings) and the cap and disk are now properly oriented with respect to each other. The closure assembly of cap and disk may now be snapped over the neck of the container without further registration and means may be provided for affixing the disk immovably to the top wall of the neck. Such means may simply comprise first applying an adhesive material to the neck top wall prior to snapping the closure onto the neck. In a preferred embodiment, the disk is sealed to the neck by induction sealing whereby the disk surface to be sealed to the neck comprises a heat sealable material, e.g., polyethylene or polypropylene, as does the neck wall. Radio frequency waves are aimed at this interface to effect the heat sealing.

For this purpose, a preferable disk comprises aluminum foil sandwiched between a layer of wood pulp board and a layer of heat sealable material. The board provides stiffness, and the aluminum foil will convert radio frequency waves into a circulating electric current which, when passed through the resistance of the foil, creates heat which will heat seal the heat sealable layer to the neck of the container.

Figure 7:
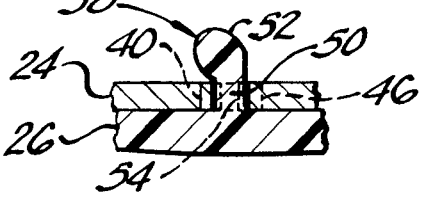
FIG. 7 is a cross-sectional view of the projection and the slot, taken through line 7—7 of FIG. 6*a;*

Preferably, means are provided to insure that the disk may be easily fitted into the cap during assembly with the projection engaged by the slot and that the disk will remain properly registered with the cap as the closure is snapped onto the container and the disk affixed to the neck. One such means are illustrated in FIGS. 6, 6*a*, and 7. As best viewed in FIG. 7, the projection 38 comprises a post portion 50 and an enlarged portion 52. Preferably the enlarged portion is ovoid in shape and somewhat off center from the axis of the post. The slot 40 is tapered, having as wide end 46, wide enough to accomodate the enlarged portion (see FIG. 6) and a narrow end 48, wide enough to accomodate the post but not the enlarged portion (see FIG. 6*a*). Accordingly the projection may be easily fitted into the slot and the wide end thereof and, by rotating the disk so that the projection is in the narrow position, the disk will be held in place by the projection bearing against the walls defining the narrow portion of the slot.

To further insure that the disk will not be moved out of this position when affixing the closure to the container, the entrance to the narrow portion of the slot may be provided with a still narrower neck 54, slightly narrower than the width of the post. Accordingly, provided that the disk is constructed of a deformable material, such as for example, the three part laminate set out above, the post may be forced into the narrow section through the neck which will recover some of the required deformation and further serve to hold the disk in proper registration.

Figure 10:
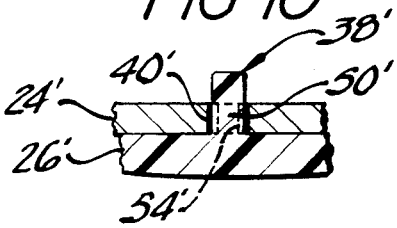
FIG. 10 is a similar view as that of FIG. 7 with respect to the alternate embodiment for the projection and slot.
Figure 8:
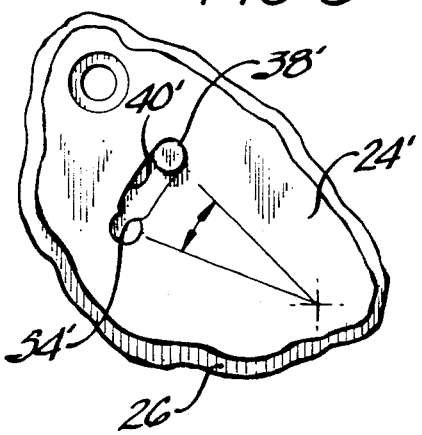
FIG. 8 is a similar view as that of FIG. 6 showing alternate embodiments of the projection and slot.
Figure 9:
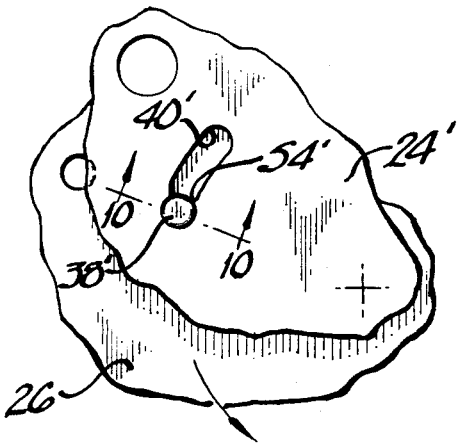
FIG. 9 is a similar view as that of FIG. 6*a* with respect to the alternate embodiments for the projection and slot.

It will be understood that various other means may be provided for holding the disk in place after registration with the cap end during assembly. For example, the constricted neck described in relation to FIGS. 6 and 6*a* may be used without resort to an eccentric enlarged portion of the projection cooperating with a slot of varying widths. Such a simplification is illustrated in FIGS. 8, 9, and 10 wherein the slot 40' is of uniform width with the exception of a narrow neck 54' at the non-dispensing end of the slot. The neck 54' has a width slightly less than that of the projection 38'. In this case, the projection 38' is in the shape of a simple right cylinder and the deformation/recovery of the neck 54' is relied upon to hold the disk in place during assembly.

It will be apparent that various other shapes may be employed for the slots and projections to facilitate the assembly of the closure of this invention.

What is claimed is:

1. In combination, a container having a fillable opening and a two-piece closure for said fillable opening comprising:

an outer cap overlying said opening and rotatably engaged upon said container, said cap provided with a closed top having a pattern of apertures therethrough for dispensing contents from the container; the inner surface of said top having one or more projections extending toward said fillable opening of said container, said projections comprising a post extending from the inside of said cap and terminating in an enlarged portion;

a disk, affixed to said container and overlying said fillable opening, said disk having a pattern of apertures therethrough with which the apertures in the cap may be rotated into alignment for dispensing contents from the container;

said disk further being provided with one or more slots, each engaging each of said one or more projections, said slots having a varying width, decreasing from one end to the other and said enlarged portion of said posts having a width greater than the width of the narrowest part of the slots; and means provided for limiting the cap rotation and the travel of said projections within said slots;

said projections and said slots being positioned so that a first extreme limit of travel of a projection within a slot, the apertures in said cap align with the apertures in said disk to allow dispensing of contents of the container whereas at a second extreme limit of travel of a projection within a slot said apertures in said cap are misaligned with said apertures in said disk to prevent dispensing of said contents.

2. The container and closure of claim 1, wherein said means for limiting cap rotation comprise a plurality of bosses on said container adapted to cooperate with a plurality of bosses on said cap.

3. The container and closure of claim 1 wherein said means for limiting cap rotation comprises the extreme ends of said slots.

4. The container and closure of claim 1 wherein said enlarged portion is ovoid in shape.

5. The container and closure of claim 1 wherein said enlarged portion is off-center with respect to the axis of said post.

6. The container and closure of claim 1 wherein said slot is provided with a constriction near one end of the slot.

7. The container and closure of claim 1 wherein said disk is affixed to said container by adhesive means.

8. The container and closure of claim 1 wherein said disk is heat sealed to said container.

9. A method for assembling a container having a fillable opening end a closure therefor wherein said closure comprises:

an outer cap for overlying said opening and rotatably engaging said container, said cap provided with a closed top having a pattern of apertures therethrough for dispensing contents from the container; the inner surface of said top having one or more projections extending therefrom;

a disk for overlying said fillable opening, said disk having a pattern of apertures therethrough with which the apertures in the cap may be rotated into alignment for dispensing contents from the container of disk further being provided with one or more slots, each for engaging each of said one or more projections;

the method comprising the steps:

fitting said disk into said cap with said projections engaged by said slots;

engaging said cap upon said container; and affixing said disk to said container.

10. The method of claim 9 wherein said disk is affixed by adhesive means.

11. The method of claim 9 wherein said disk is affixed by heat sealing means.

* * * * *

UNITED STATES PATENT AND TRADEMARK OFFICE

CERTIFICATE OF CORRECTION

PATENT NO. : 4,488,668

DATED : December 18, 1984

INVENTOR(S) : Joseph M. Flaska and Robert F. Wittemann

It is certified that error appears in the above-identified patent and that said Letters Patent are hereby corrected as shown below:

Claim 1, Column 7, line 34 "of said cap and . . ." should read --of said cap top and--.

Claim 1, Column 7, line 49 "so that a first . . ." should read --so that at a first--.

Signed and Sealed this

*Thirteenth* Day of *August 1985*

[SEAL]

*Attest:*

DONALD J. QUIGG

*Attesting Officer* *Acting Commissioner of Patents and Trademarks*